US012016417B2

(12) United States Patent
Yarlagadda et al.

(10) Patent No.: US 12,016,417 B2
(45) Date of Patent: Jun. 25, 2024

(54) PROTECTIVE HELMET

(71) Applicant: HONEYWELL INTERNATIONAL INC., Charlotte, NC (US)

(72) Inventors: Prudhvi Krishna Yarlagadda, Charlotte, NC (US); Rizwan Ahmad, Charlotte, NC (US); Alan Schierenbeck, Charlotte, NC (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 97 days.

(21) Appl. No.: 17/218,666

(22) Filed: Mar. 31, 2021

(65) Prior Publication Data

US 2021/0330018 A1 Oct. 28, 2021

(30) Foreign Application Priority Data

Apr. 27, 2020 (IN) ..... 202011017952

(51) Int. Cl.
*A42B 3/06* (2006.01)
*A42B 3/12* (2006.01)
*A42B 3/14* (2006.01)

(52) U.S. Cl.
CPC ..... *A42B 3/064* (2013.01); *A42B 3/124* (2013.01); *A42B 3/14* (2013.01)

(58) Field of Classification Search
CPC ..... A42B 3/064; A42B 3/124; A42B 3/14; A42B 3/065
See application file for complete search history.

(56) References Cited

U.S. PATENT DOCUMENTS 3,425,061 A * 2/1969 Webb ..... A42B 3/065 D29/102
3,500,473 A * 3/1970 Marchello ..... A42B 3/065 2/414

(Continued)

FOREIGN PATENT DOCUMENTS

EP 2389822 A1 11/2011

OTHER PUBLICATIONS

CA Office Action dated Aug. 12, 2022 for CA Application No. 3115001.

(Continued)

*Primary Examiner* — Bao-Thieu L Nguyen
(74) *Attorney, Agent, or Firm* — Alston & Bird LLP

(57) ABSTRACT

Various embodiments are directed to a protective helmet comprising: a protective shell having a substantially dome-shaped configuration, the protective shell comprising: an outer shell surface; an inner shell surface; and at least one groove extending along at least a portion of the inner shell surface, wherein the at least one groove is embodied as a material recess within a wall thickness; wherein a ratio of the shell thickness at a first shell location adjacent the at least one groove to the groove depth of the at least one groove is at least a predetermined threshold value. In various embodiments, a protective helmet may further comprise an impact cap and/or an inner ring, one or both of which may comprise a respective groove configuration. In various embodiments, the one or more groove configurations may be configured to reduce the helmet weight of the invention by at least 15%.

7 Claims, 6 Drawing Sheets

(56) References Cited

U.S. PATENT DOCUMENTS

| | | | | |
|---|---|---|---|---|
| 6,694,529 | B1 * | 2/2004 | Chiu | A42B 3/065 2/417 |
| 7,802,320 | B2 * | 9/2010 | Morgan | A42B 3/124 2/412 |
| 9,314,062 | B2 | 4/2016 | Marz et al. | |
| 10,588,372 | B2 * | 3/2020 | Ho | A42B 3/124 |
| 10,806,201 | B2 * | 10/2020 | Morgan | A41D 31/285 |
| 2003/0140400 | A1 * | 7/2003 | Ho | A42B 3/063 2/412 |
| 2007/0000032 | A1 * | 1/2007 | Morgan | A42B 3/124 2/412 |
| 2010/0000009 | A1 * | 1/2010 | Morgan | A42B 3/128 2/414 |
| 2010/0299813 | A1 * | 12/2010 | Morgan | A42B 3/124 2/414 |
| 2012/0198604 | A1 * | 8/2012 | Weber | A42B 3/125 2/410 |
| 2017/0303612 | A1 * | 10/2017 | Morgan | A41D 31/285 |
| 2018/0255861 | A1 * | 9/2018 | Ho | A42B 3/063 |
| 2019/0110545 | A1 * | 4/2019 | Lee | A42B 3/12 |
| 2022/0015488 | A1 * | 1/2022 | Adams | A42B 3/063 |

OTHER PUBLICATIONS

CA Office Action dated Feb. 9, 2023 for CA Application No. 3115001, 4 page(s).
CA Notice of Allowance dated Jun. 27, 2023 for CA Application No. 3115001, 1 page(s).

* cited by examiner

PROTECTIVE HELMET

CROSS-REFERENCE TO RELATED APPLICATIONS

This application claims priority pursuant to 35 U.S.C. 119(a) of India Patent Application No. 202011017952, filed Apr. 27, 2020, which application is incorporated herein by reference in its entirety.

FIELD OF THE INVENTION

Various embodiments described herein relate generally to protective helmets. In particular, various embodiments are directed to wearable helmets configured for protecting the head of a user from harmful physical contact with an object in a user's environment.

BACKGROUND

Consumers in industrial and commercial applications may use protective helmets to protect the consumer's head from harmful physical contact with an object. In particular, a protective helmet may be used to provide protection from one or more objects falling within the consumer's environment by acting as a physical barrier between the consumer's head and the one or more falling objects. Through applied effort, ingenuity, and innovation, Applicant has solved problems relating to protective helmets by developing solutions embodied in the present disclosure, which are described in detail below.

BRIEF SUMMARY

Various embodiments are directed to a protective helmet and method of using the same. In various embodiments, a protective helmet comprises: A protective helmet comprising: a protective shell having a substantially dome-shaped configuration, the protective shell comprising: an outer shell surface; an inner shell surface comprising a lower perimeter and defining, at least in part, an internal shell portion configured to receive at least a portion of a head of a user extending through the lower perimeter of the inner shell surface; and at least one groove extending along at least a portion of the inner shell surface, wherein the at least one groove is defined at least in part by a groove depth; wherein the protective shell is defined at least in part by a shell thickness defined at least in part by a perpendicular distance between the outer shell surface and the inner shell surface; wherein the at least one groove is embodied as a material recess within the cap thickness extending from the inner shell surface to a maximum recession point, wherein the groove depth of the at least one groove is defined at least in part by a distance between the inner shell surface and the maximum recession point of the at least one groove; and wherein a ratio of the shell thickness at a first shell location adjacent the at least one groove to the groove depth of the at least one groove is at least a predetermined threshold value.

In various embodiments, the predetermined threshold value of the ratio of the shell thickness at the first shell location adjacent the at least one groove to the groove depth of the at least one groove may be between 1.5:1 and 3:1. In various embodiments, the groove configuration may be configured to reduce a shell weight of the protective shell by at least 10%. In various embodiments, the ratio of the shell thickness at the first shell location adjacent the at least one groove to the groove depth of the at least one groove may be different than a second ratio of the shell thickness at a second shell location adjacent the at least one groove to the groove depth of the at least one groove.

Various embodiments are directed to a protective helmet comprising: a protective shell; and an inner ring; wherein each of the protective shell and the inner ring are defined by a respective wall thickness; wherein one or more of the protective shell and the inner ring comprises a groove configuration defined by at least one groove, wherein the at least one groove is embodied as a material recess extending into the respective wall thickness from a respective surface thereof; and wherein the groove configuration is configured to reduce an amount of material within the protective helmet.

In various embodiments, the at least one groove may be defined in part by a respective groove depth, and wherein the groove configuration is defined by a ratio of the respective wall thickness at a first location adjacent the at least one groove to the groove depth of the at least one groove is at least a predetermined threshold value. Further, in various embodiments, the predetermined threshold value of the ratio of the respective wall thickness at the first location adjacent the at least one groove to the groove depth of the at least one groove may be between 1.5:1 and 3:1. In various embodiments, each of the protective shell and the inner ring comprises a respective groove configuration. In certain embodiments, the groove configuration may be configured to reduce a helmet weight of the protective helmet by at least 15%. In various embodiments, the ratio of the respective wall thickness at the first location adjacent the at least one groove to the groove depth of the at least one groove may be different than a second ratio of the respective wall thickness at a second location adjacent the at least one groove to the groove depth of the at least one groove.

In various embodiments, the protective helmet may further comprise an impact cap, wherein the protective helmet is configured such that the impact cap is positioned at least partially between the protective shell and the inner ring such that the impact cap defines an intermediate buffer between the shell and the inner ring. In certain embodiments, the impact cap may comprise at least one impact cap groove configuration defined by one or more impact cap grooves, wherein the one or more impact cap groove are embodied as a material recess extending into an impact cap wall thickness from an external surface thereof.

Various embodiments are directed to protective helmet comprising: a protective shell; an impact cap; and an inner ring; wherein each of the protective shell, the impact cap, and the inner ring are defined by a respective wall thickness; wherein one or more of the protective shell, the impact cap, and the inner ring comprises a groove configuration defined by one or more grooves, wherein the one or more grooves are embodied as a material recess extending into the respective wall thickness from a respective surface thereof and wherein the groove configuration is configured to reduce an amount of material within the protective helmet.

In various embodiments, the at least one groove may be defined in part by a respective groove depth, and wherein the groove configuration is defined by a ratio of the respective wall thickness at a first location adjacent the at least one groove to the groove depth of the at least one groove is at least a predetermined threshold value. In various embodiments, the predetermined threshold value of the ratio of the respective wall thickness at the first location adjacent the at least one groove to the groove depth of the at least one groove may be between 1.5:1 and 3:1. In various embodiments, each of the protective shell, the impact cap, and the inner ring may comprise a respective groove configuration. In various embodiments, the groove configuration may be configured to reduce a helmet weight of the protective helmet by at least 15%. In various embodiments, the ratio of the respective wall thickness at the first location adjacent the at least one groove to the groove depth of the at least one groove may be different than a second ratio of the respective wall thickness at a second location adjacent the at least one groove to the groove depth of the at least one groove.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
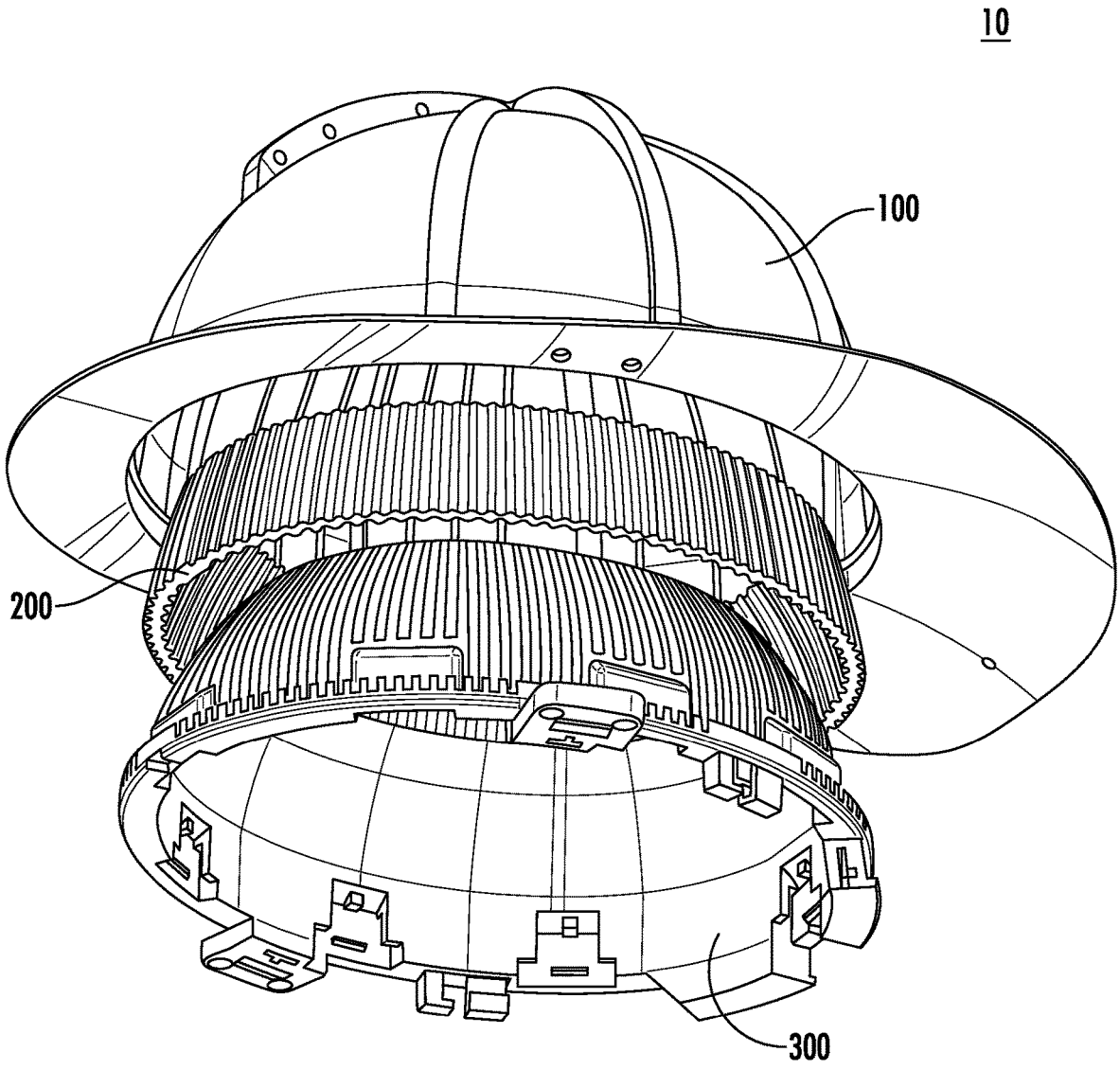
FIG. 1 illustrates an exploded view of an exemplary protective helmet according to an embodiment.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

The words "example," or "exemplary," when used herein, are intended to mean "serving as an example, instance, or illustration." Any implementation described herein as an "example" or "exemplary embodiment" is not necessarily preferred or advantageous over other implementations.

Various types of personal protective equipment (PPE) can be worn by a user to protect the user from various types of dangerous conditions within the user's environment. Protective helmets, for example, to protect a user's head from harmful forces resulting in physical contact with an object in the user's ambient environment. Conventionally, in order to provide PPE capable of providing a higher level of user protection, the equipment may be designed to be heavier or comprise an increased amount of material, so as to, for example, increase a coverage area or produce a stronger, more robust product. However, a weight increase in of a piece of PPE may generate increased physiological stress on a user's body and may decrease a user's mobility. With respect to protective helmets, the stress applied atop a user's neck (e.g., by the protective helmet) is particularly critical, as the distance between the user's head and the user's center of gravity results in the force of the applied stress being assigned a force multiplier approximately 6:1. That is, for every pound added to the weight of a protective helmet, a user wearing the helmet experiences an additional 5 to 6 pounds of physiological stress. Further, various occupational and recreational activities are conducted in environments requiring PPE performance to remain consistent while being exposed to extreme temperatures. For example, conventional firefighting helmet certifications include a required preconditioned temperature range from between −32° C. (−25° F.) and 260° C. (500° F.), requiring a helmet to maintain its structural integrity through various strength tests (e.g., testing crush resistance, tensile strength, impact resistance, penetration resistance, and/or the like) conducted at such extreme temperatures.

Described herein is a protective helmet configured to be worn by a user so as to protect the user's head from harmful forces that may be transmitted through physical engagement with an object within the user's environment. The protective helmet comprises a plurality of features that provide desirable strength characteristics while minimizing the weight of the helmet by minimizing the required amount of material necessary to construct the protective helmet having the desired strength characteristics. For example, various features may comprise one or more grooves, ribs, raised features, and/or the like, that may extend across planar surfaces, curved surfaces, and/or complex curved surfaces in order to provide crush resistance, tensile strength, impact resistance, penetration resistance, and/or the like for the protective helmet. Further, a protective helmet as described herein may be configured such that the various features may increase the heat dissipation capacity of the protective helmet so as to facilitate the operability of the helmet at extreme temperature conditions. For example, the various features of a protective helmet described herein may include, for example, a groove configuration configured to increase the surface area of the helmet, thereby facilitating a more effective heat transfer between the helmet and an ambient environment.

As described herein, the disclosed protective helmet comprise various protective components, such as, for example, a shell, an impact cap, and/or an inner ring. At least one of the protective components may include one or more groove configurations, which may be embodied as one or more grooves recessed into a surface of the protective component. A shell, an impact cap, and/or an inner ring of protective helmet described herein may comprise one or more grooves within a respective outer surface, a respective inner surface, or both. A groove within a protective component of the protective helmet described herein may comprise a material recess within the thickness of the protective component, such that an exemplary protective component having one or more grooves may comprise a lesser amount of material than a similarly sized protective component having the same thickness and zero grooves. As described herein, such a reduction in material required to manufacture one or more of a protective helmet's protective components corresponds to a protective helmet that weighs less than a similarly configured helmet without a groove configuration. In particular, the grooves of the one or more protective components of the protective helmet may be configured such that the protective helmet may maintain desirable strength characteristics while reducing the amount of physiological stress placed upon the neck of a user wearing the helmet. For example, as described herein, one or both of the groove configuration and the wall thickness of various portions of the one or more protective components may be selectively varied in order to strategically modify the distribution of strength characteristics throughout the one or more components as needed, based at least in part on the application and/or environment in which the protective helmet may be used. As a non-limiting example, a protective helmet as described herein may comprise various groove configurations such that the helmet weighs about 3.50 lbs., which may represent an approximately 20% weight reduction compared to conventional protective helmets.

In various embodiments, an exemplary protective helmet may comprise a shell. In various embodiments, the protective helmet may further comprise an impact cap and/or an inner ring. FIG. 1 illustrates an exploded view of various components of an exemplary protective helmet 10 according to various embodiments. As illustrated in FIG. 1, protective helmet 10 may comprise a shell 100, an impact cap 200, and an inner ring 300. As described herein, the protective helmet 10 may define an at least partially stacked configuration wherein the impact cap 200 may be configured to fit at least partially within an internal shell portion of the shell 100. Further, the inner ring 300 may be configured to fit at least partially within an internal portion of the impact cap 200, such that the impact cap 200 may act as an intermediate buffer positioned in between the shell 100 and the inner ring 300. As described herein, inner ring 300 may comprise an internal portion configured to receive at least a portion of a user's head such that the inner ring 300 may define an interface at which the user's head may engage the protective helmet 10 such that the protective helmet 10 rests on top of the user's head.

Figure 2A:
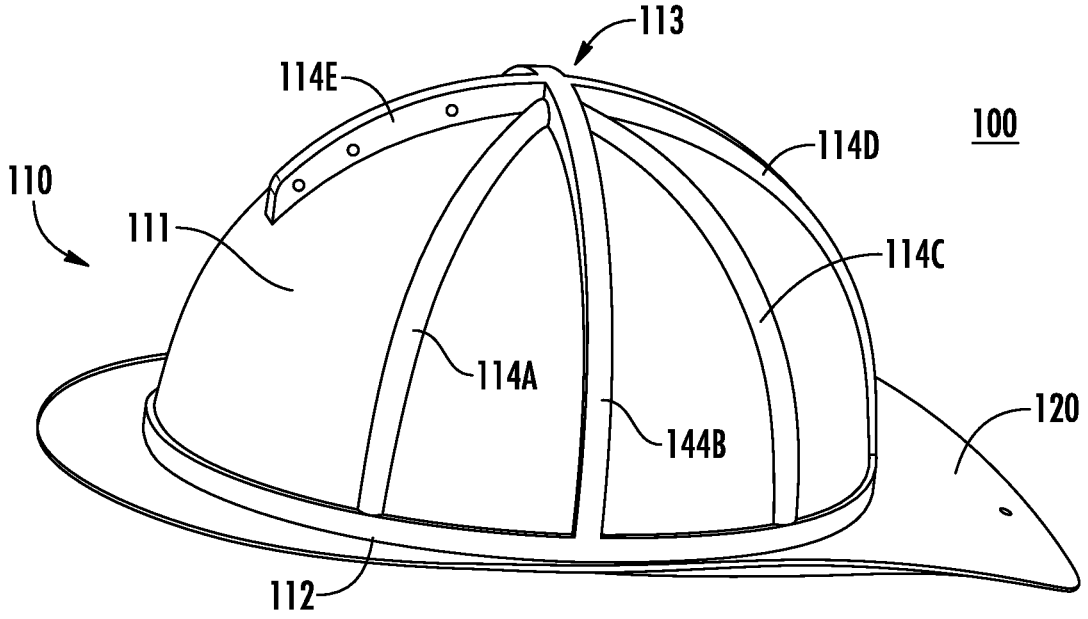
FIGS. 2A-2B illustrate various perspective views of a protective helmet according to an embodiment.
Figure 2B:
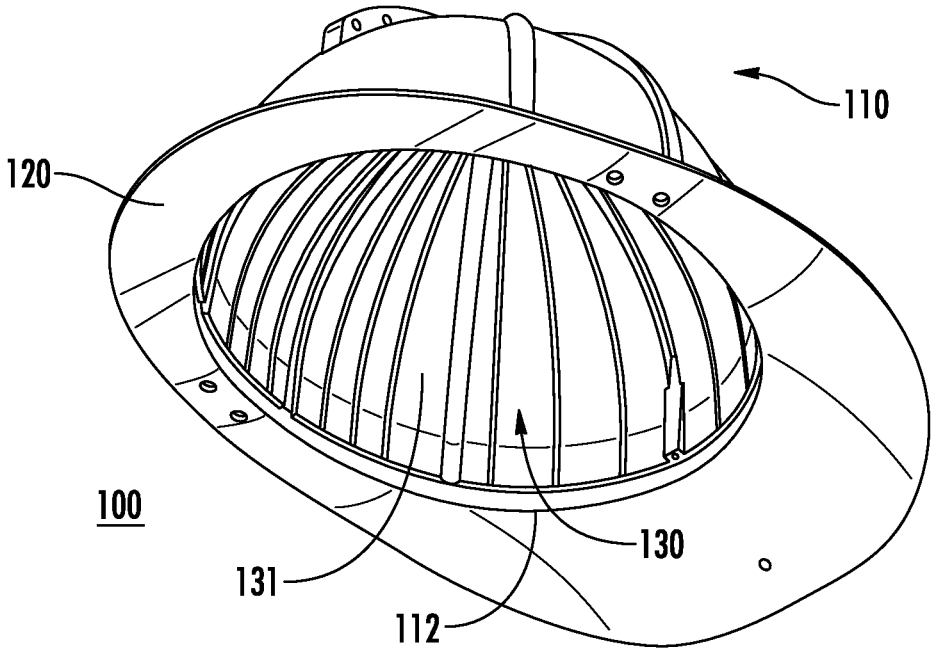

FIGS. 2A-2B illustrate an exemplary component of a protective helmet according to various embodiments. In particular, FIGS. 2A-2B show various perspective views of an exemplary shell 100 according to various embodiments. As described herein, the shell 100 may define the upper and outermost boundaries of the protective helmet 10 such that an object travelling towards the head of a user wearing the protective helmet 10 may engage the shell 100 rather than the user's head. The shell 100 may be configured to receive a force transmitted from an external object moving relative thereto. In various embodiments, the shell may be configured to transmit at least a portion of the force received from an external object to one or more components of the protective helmet 10, such as, for example, the impact cap 200 or the inner ring 300, as described herein.

In various embodiments, the shell 100 may comprise a substantially hard material that is capable of withstanding high-impact forces without being penetrated or otherwise compromised, in particular in conditions of extreme temperatures (e.g., between −32° C. (−25° F.) and 260° C. (500° F.)). For example, in various embodiments, the shell 100 may be made of various leather, metal, and/or plastic materials, such as glass-filled thermoset and/or thermoplastics. For example, the shell 100 may be manufactured using various compression molding, injection molding, CNC machining, additive manufacturing (e.g., 3D printing) processes, and/or the like.

As illustrated, in various embodiments, shell 100 may comprise a cap portion 110 and a brim portion 120. In various embodiments, the cap portion 110 may comprise a substantially rounded dome configuration defined in part by an outer shell surface 111. The outer shell surface 111 of the cap portion 110 may comprise a curved profile extending between an at least substantially circular (e.g., oval-shaped) lower perimeter 112 and a central outer peak 113 located at the uppermost point of the dome-shaped outer shell surface 111 of the cap portion 110. In various embodiments, the brim portion 120 of the shell 100 may extend in an outward direction from the outer shell surface 111 of the cap portion along at least a portion of the lower perimeter 112 of the cap portion 110. For example, as illustrated, the brim portion 120 may extend around the entirety of the lower perimeter 112 of the cap portion 110. In various embodiments, the cap portion 110 may further comprise one or more outer shell ribs extending along at least a portion of the outer shell surface 111. For example, the outer shell ribs 114A, 114B, 114C, 114D, 114E may protrude from the outer shell surface 111 and extend between the lower perimeter 112 and the central outer peak 113. As described herein, a rib (e.g., outer shell rib) may be defined at least in part by a rib height, a rib length, a rib width, and a rib shape. For example, the rib height may be defined as the distance between the surface from which the rib protrudes (e.g., an outer shell surface 111) and an outermost point of protrusion of the rib (e.g., measured perpendicularly). Further, the rib width may be defined as the distance along the surface from which the rib protrudes (e.g., an outer shell surface 111) between the two rib sidewalls extending from the surface from which the rib protrudes (e.g., measured perpendicularly to the length of the rib). Further, the rib length may be defined as the distance that the rib extends along the surface from which the rib protrudes. For example, each rib may comprise a first end and a second end, wherein the rib length is the distance measured along the rib between the first end and the second end of the rib. Further, the rib shape may be defined as the cross-sectional configuration of the rib. For example, in various embodiments, a rib may comprise a squared cross-section, a rounded cross-section, a triangular cross-section, and/or the like. In various embodiments, the rib height, rib width, and/or rib shape may vary along the length of the rib.

In various embodiments, the one or more outer shell ribs may comprise a plurality of outer shell ribs. In such an exemplary circumstance, the plurality of outer shell ribs may be arranged about the outer shell surface 111 of the cap portion. For example, as illustrated in FIG. 2A, the plurality of outer shell ribs (e.g., 114A, 114B, 114C, 114D, 114E) may be distributed about the outer shell surface 111 of the cap portion 110 in a substantially even distribution such that the distance between various proximate ribs of the plurality of outer shell ribs is at least substantially similar. In various embodiments, one or more outer shell ribs may extend along the outer shell surface 111 in one or more different directions, such as, for example, a vertical direction (e.g., between the lower perimeter 112 and the central outer peak 113), an annular direction (e.g., at least substantially parallel to the lower perimeter 112), and/or the like. Similarly, in various embodiments, one or more outer shell ribs may comprise either a liner rib or a curved rub (e.g., a non-linear rib). In various embodiments, each of the outer shell ribs may comprise either the same or different rib height, rib length, and/or rib shape. For example, as illustrated, a first portion of the plurality of outer shell ribs 114A, 114C may comprise a rounded cross-sectional configuration, while a second portion of the plurality of outer shell ribs 114B, 114D, 114E may comprise a squared cross-sectional configuration. Further, for example, a first portion of the plurality of outer shell ribs 114A, 114B, 114C, 114D may extend along the outer shell surface 111 between the lower perimeter 112 of the cap portion and the central outer peak 113, while a second portion of the plurality of outer shell ribs 114E may have a shorter rib length such that the rib 114E extends along only part of the distance between the central outer peak 113 and the lower perimeter 112.

As illustrated in FIG. 2B, the shell 100 may comprise an internal shell portion 130 embodied as the interior of the dome-shaped cap portion 110. The internal shell portion 130 may be configured to receive at least a portion of the head of a user such that the protective helmet may be worn by the user on the user's head, as described herein. In various embodiments, the internal shell portion 130 may comprise an inner shell surface 131. In various embodiments, the inner shell surface 131 of the cap portion 110 may comprise a curved profile extending between the lower perimeter 112 and a central inner peak located at the uppermost point of the dome-shaped inner shell surface 131. For example, in various embodiments, the inner shell surface 131 may be configured at least substantially similarly to the outer shell surface 111. In various embodiments, the cap portion 110 of the shell 100 may be configured such that the inner shell surface 131 is positioned a distance away from the outer shell surface 111. The distance between the inner shell surface 131 and the outer shell surface 111 may define the thickness of cap portion 110 (e.g., the shell cap thickness). In various embodiments, the shell cap thickness may be either uniform or variable at one or more points throughout the cap portion 110. For example, the shell cap thickness may be at least substantially between 0.06 inches and 0.16 inches (e.g., between 0.08 inches and 0.12 inches).

Figure 3:
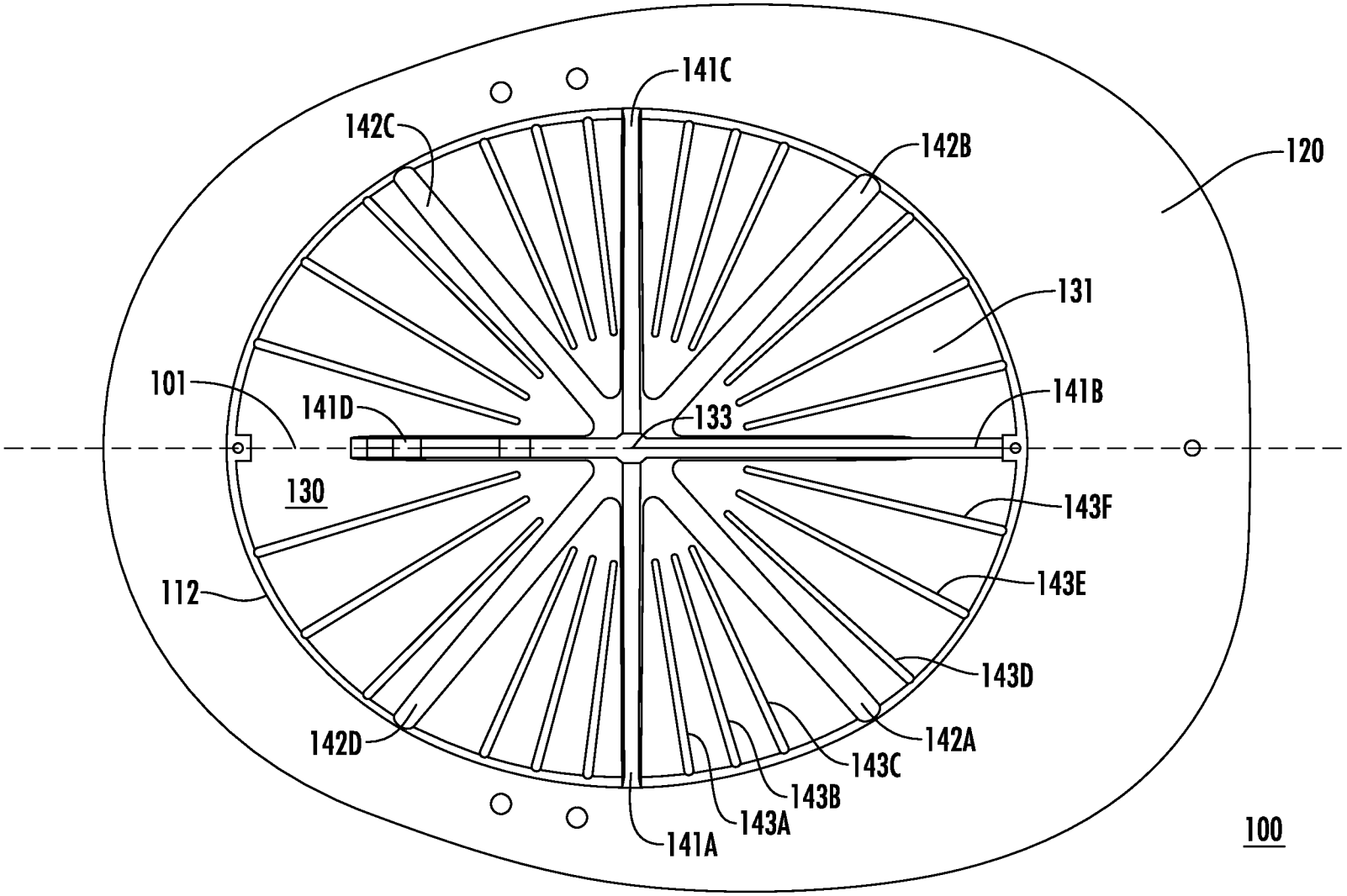
FIG. 3 illustrates a bottom view of a protective helmet according to an embodiment.

FIG. 3 illustrates a bottom perspective view of an exemplary shell 100 according to various embodiments. In particular, FIG. 3 illustrates the internal shell portion 130 of the shell 100. In various embodiments, the internal shell portion 130 may comprise one or more inner shell grooves extending along at least a portion of the inner shell surface 131. For example, the inner shell grooves may extend from the inner shell surface 131 and protrude (e.g., recess) into the shell cap thickness of the cap portion 110. In various embodiments, the inner shell grooves may extend along at least a portion of the inner shell surface 131 between the lower perimeter 112 and the central inner peak 133. As described herein, a groove may embody a material recess within the shell cap thickness of the shell 100, such that an exemplary cap portion 110 of a shell having one or more grooves may comprise a lesser amount of material than a similarly sized cap portion having the same shell cap thickness and zero grooves. Accordingly, as described herein, the exemplary cap portion 110 having one or more grooves may weigh less than a similarly sized cap portion having the same shell cap thickness and zero grooves. Moreover, in various embodiments, a groove positioned within a cap portion 110 of the shell may increase the surface area of the cap portion 110, thereby increasing the heat dissipation capacity of the cap portion by facilitating a more effective heat transfer between the cap portion surface and the ambient environment. Furthermore, in various embodiments, the one or more grooves may be configured such that an exemplary shell with one or more grooves may exhibit similar strength characteristics and piercing resistance as a similarly configured, heavier shell that has no grooves.

As described herein, a groove (e.g., inner shell groove) may be defined at least in part by a groove depth, a groove width, a groove length, and a groove shape. For example, the groove depth may be defined as the distance between the surface into which the groove extends (e.g., an inner shell surface 131) and an innermost point of recession of the groove (e.g., measured perpendicularly). Further, the groove width may be defined as the distance along the surface into which the groove recesses (e.g., an inner shell surface 131) between the two groove sidewalls extending from the surface into which the groove recesses (e.g., measured perpendicularly to the length of the groove). In various embodiments, the width of one or more of the squared primary grooves may vary along the depth of the groove such that the groove width is different than, for example, the width of the groove at the deepest portion of the groove. Further, the groove length may be defined as the distance that the groove extends along the surface from which the groove recesses. For example, each groove may comprise a first end and a second end, wherein the groove length is the distance measured along the groove between the first end and the second end of the groove. Further, the groove shape may be defined as the cross-sectional configuration of the groove. For example, in various embodiments, a groove may comprise a squared cross-section, a rounded cross-section, a triangular cross-section, and/or the like. In various embodiments, the groove depth, groove width, and/or groove shape may vary along the length of the groove.

In various embodiments, the one or more inner shell grooves may comprise a plurality of inner shell grooves. In such an exemplary circumstance, the plurality of inner shell grooves may be arranged about the inner shell surface 131 of the cap portion 110. For example, as illustrated in FIG. 3, the plurality of inner shell grooves may be distributed about the inner shell surface 131 of the cap portion 110. In various embodiments, one or more inner shell grooves may extend along the inner shell surface 131 in one or more different directions, such as, for example, a vertical direction (e.g., between the lower perimeter 112 and the central inner peak 133), an annular direction (e.g., at least substantially parallel to the lower perimeter 112), and/or the like. Similarly, in various embodiments, one or more inner shell grooves may comprise either a liner groove or a curved groove (e.g., a non-linear groove). In various embodiments, each of the inner shell grooves may comprise either the same or different groove depth, groove length, and/or groove shape. For example, a first portion of a plurality of inner shell grooves may comprise a rounded cross-sectional configuration, while a second portion of the plurality of the inner shell grooves may comprise a squared cross-sectional configuration. Further, for example, a first portion of a plurality of inner shell grooves may extend along the inner shell surface 131 between the lower perimeter 112 and the central inner peak 133, while a second portion of the plurality of inner shell grooves may have a shorter groove length such that the groove extends along only part of the distance between the central inner peak 133 and the lower perimeter 112.

As illustrated in FIG. 3, the shell 100 may comprise a plurality of inner shell grooves comprising one or more primary grooves and one or more intermediate grooves. In various embodiments, the one or more primary grooves may comprise linear grooves extending in a vertical direction from lower perimeter 112 to the central inner peak 133 and may have a groove width that is at least substantially larger than the groove width of the one or more intermediate grooves, as described herein. In various embodiments, at least a portion of the plurality of primary grooves may be distributed about the inner shell surface 131 in a substantially even distribution such that the distance between various proximate primary grooves of the plurality of primary grooves is at least substantially similar. In various embodiments the one or more primary grooves may comprise between four and twelve primary grooves (e.g., between eight and ten primary grooves). For example, in various embodiments, the groove depth of one or more primary grooves may be at least substantially between 0.04 inches and 0.14 inches (e.g., between 0.06 inches and 0.13 inches). By way of further example, in various embodiments, one or more of the primary grooves may comprise a groove width of at least substantially between 0.079 inches and 0.787 inches (e.g., between 0.315 inches and 0.512 inches). In various embodiments, the one or more primary grooves may comprise a plurality of primary grooves having either the same or different groove shape. For example, a plurality of primary grooves may comprise one or more rounded primary grooves, such as, for example, primary grooves 142A, 142B, 142C, 142D. Further, in various embodiments, the plurality of primary grooves may comprise one or more squared primary grooves, such as, for example, primary grooves 141A, 141B, 141C, 141D. Further a groove transition between the inner shell surface 131 and an inner shell groove may comprise either an angled transition or a curved transition. For example, in various embodiments, the groove transition may define a groove transition angle of at least substantially between 0 degrees and 90 degrees (e.g., between 45 degrees and 90 degrees) relative to the inner shell surface 131. Further, in various embodiments, the groove transition may define a groove transition radius of curvature of at least substantially between 0.2 inches and 0.5 inches (e.g., between 0.25 inches and 0.4 inches). In various embodiments, the cap portion 110 of the shell 100 may be configured such that a ratio of the shell cap thickness to groove depth of the one or more primary grooves may be 1:1 and 3.5:1 (e.g., between 1.5:1 and 3:1).

In various embodiments, the cap portion 110 may be configured such that the groove depth, groove length, groove length, and/or groove shape of one or more primary groove may at least partially correspond to a rib height, rib width, rib length, and/or rib shape of an outer shell rib arranged along the outer shell surface in a position adjacent to the position of the primary groove along the inner shell surface 131. For example, in such an exemplary circumstance, the configuration of the inner shell groove and the corresponding outer shell rib may be such that the distance between the inner shell groove and the corresponding outer shell rib may be at least substantially equal to the shell cap thickness, as described herein.

In various embodiments, the one or more intermediate grooves may comprise linear grooves extending in a vertical direction from lower perimeter 112 towards the central inner peak 133 and may have a groove width that is at least substantially smaller than the groove width of the one or more primary grooves, as described herein. In various embodiments, at least a portion of the plurality of primary grooves may be distributed about the inner shell surface 131 in between proximate primary grooves. In various embodiments, the one or more intermediate grooves may comprise a plurality of intermediate grooves, and at least a portion of the plurality of intermediate grooves may be distributed about the inner shell surface 131 in a substantially varied distribution such that the distance between various proximate intermediate grooves of the plurality of intermediate grooves may vary. In various embodiments, as illustrated in FIG. 3, the one or more intermediate grooves may comprise between 15 and 30 intermediate grooves. Further, in various embodiments the one or more intermediate grooves may comprise between 100 and 200 intermediate grooves (e.g., between 140 and 160 intermediate grooves). For example, in various embodiments, the groove depth of one or more intermediate grooves may be at least substantially between 0.02 inches and 0.118 inches (e.g., between 0.059 inches and 0.079 inches). By way of further example, in various embodiments, one or more of the intermediate grooves may comprise a groove width of at least substantially between 0.039 inches and 0.197 inches (e.g., between 0.098 inches and 0.138 inches). Further, in various embodiments, one or more of the intermediate grooves may comprise a groove length of at least substantially between 4.0 inches and 7.0 inches (e.g., between 5.25 inches and 5.75 inches). In various embodiments, the cap portion 110 of the shell 100 may be configured such that a ratio of the shell cap thickness to groove depth of the one or more intermediate grooves may be at least substantially between 1.167:1 and 3.5:1 (e.g., between 1.5:1 and 3:1).

In various embodiments wherein the one or more intermediate grooves comprises a plurality of intermediate grooves, the intermediate grooves of the plurality may have either the same or different groove shapes. For example, a plurality of intermediate grooves may comprise one or more intermediate grooves having a rounded cross-sectional configuration, such as, for example, intermediate grooves 143A, 143B, 143C, 143D, while one or more intermediate grooves may have, for example, a squared cross-sectional configuration.

In various embodiments, the shell 100 may define a symmetry plane 101 extending through the center of the shell. In various embodiments, the shell 100 may be symmetrical about the symmetry plane 101, such that grooves and/or ribs on a first side of the symmetry plane 101 are equal and opposite to grooves and/or ribs on a second side of the symmetry plane 101. In various embodiments, the plurality of inner shell grooves may correspond to a material reduction of at least substantially between 300 grams and 1000 grams (e.g., between 350 grams and 850 grams) of material, which, based at least in part on the material of a shell 100, may result in a weight reduction of at least substantially between 10% and 25% (e.g., approximately 15%) to a shell 100.

As illustrated in FIG. 3, the exemplary shell 100 may comprise a plurality of inner shell grooves comprising eight primary grooves and 24 intermediate grooves distributed about the internal shell portion 130 of the cap portion 110. The plurality of primary grooves may comprise four squared primary grooves 141A, 141B, 141C, 141D and four rounded primary grooves 142A, 142B, 142C, 142D. For example, each of the squared primary grooves 141A, 141B, 141C, 141D may comprise a groove depth of 0.236 inches, a groove width of 0.315 inches, and a groove length that extends along inner shell surface 131 between the lower perimeter 112 and the central inner peak 133. Each of the squared primary grooves 141A, 141B, 141C, 141D may define an angled groove transition relative to the inner shell surface 131 of approximately 90 degrees. As a further example, each of the rounded primary grooves 142A, 142B, 142C, 142D may comprise a groove depth of 0.315 inches, a groove width of 0.315 inches, and a groove length that similarly extends along inner shell surface 131 between the lower perimeter 112 and the central inner peak 133. For example, at least a portion of the rounded primary grooves 142A, 142B, 142C, 142D may comprise an inner groove surface having a radius of curvature of approximately 0.315 inches and may define an angled groove transition relative to the inner shell surface 131 of approximately 90 degrees.

As illustrated, the plurality of intermediate grooves may comprise 24 rounded primary grooves, including intermediate grooves 143A, 143B, 143C, 143D, 143E, 143F. The plurality of intermediate grooves may comprise linear grooves distributed intermittently in sets of three intermediate grooves between the various primary grooves. For example, at least a portion of the plurality of intermediate grooves (e.g., intermediate grooves 143A, 143B, 143C, 143D, 143E, 143F) have a groove depth of 0.055 inches, a groove width of 0.055 inches, and a groove length of between 4.0 inches and 7.0 inches based at least in part on the orientation of the groove relative to the symmetry plane 101. Each of the intermediate grooves may comprise an inner groove surface having a radius of curvature of 0.055 inches and may define an angled groove transition relative to the inner shell surface 131 of approximately 90 degrees.

As illustrated in FIG. 3, the exemplary shell 100 may comprise a plurality of inner shell grooves may correspond to a weight reduction of approximately 15% to the shell 100. For example, as illustrated, shell 100 may be configured to withstand the force of a striker hitting the shell at 7 meters/second without being compromised (e.g., penetrated) such the striker engages the head of a user wearing the shell. Further, the shell 100 may be configured such that, upon being exposed to an ambient temperature that is raised from 0° C. to 260° C. in 2.5 minutes, the shell 100 may still withstand the force of a striker hitting the shell at 7 meters/second without being compromised (e.g., penetrated) such the striker engages the head of a user wearing the shell.

Figure 4A:
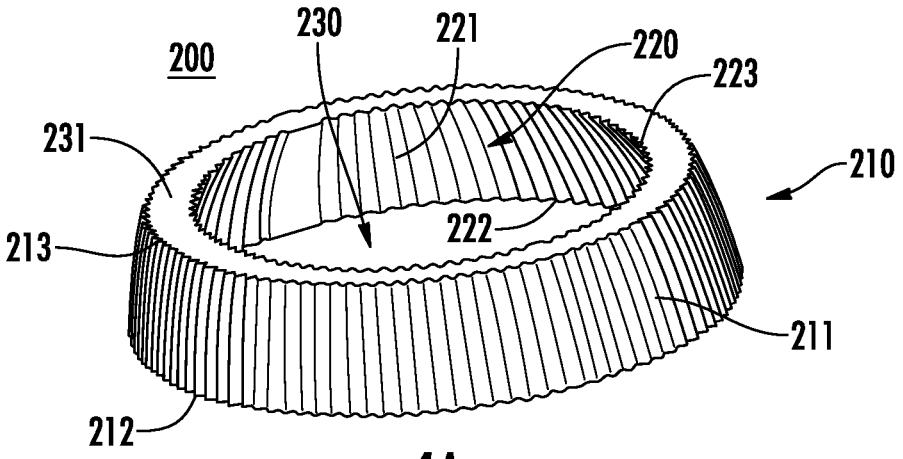
FIGS. 4A-4C illustrate various perspective views of various components of a protective helmet according to various embodiments.
Figure 4B:
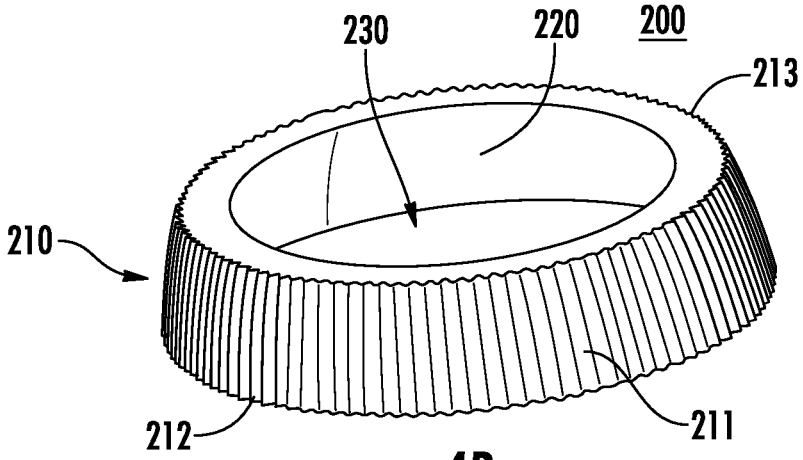
Figure 4C:
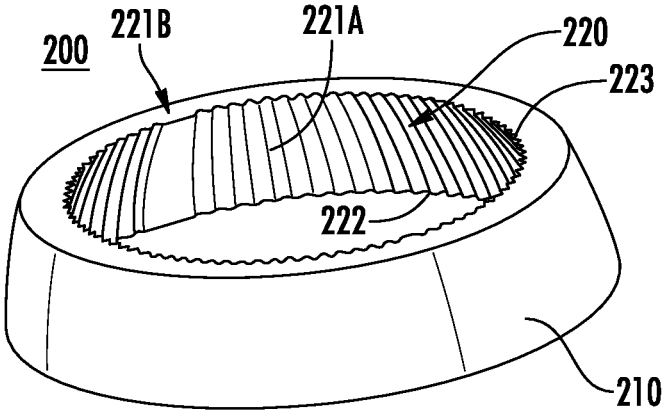

FIGS. 4A-4C illustrate an exemplary component of a protective helmet according to various embodiments. In particular, FIGS. 4A-4C show various perspective views of an exemplary impact cap 200 according to various embodiments. As described herein, a protective helmet may be configured such that an impact cap 200 may be arranged within an internal shell portion of a shell, as described herein. For example, the impact cap 200 may be configured to fit at least partially within the internal shell portion of a shell such that the impact cap 200 may act as an intermediate buffer positioned in between the shell 100 and the head of a user. In various embodiments, an impact cap 200 may comprise an internal portion configured to receive at least a portion of a user's head such that the impact cap 200 may define an interface at which the user's head may engage a protective helmet such that the protective helmet rests on top of the user's head. In various embodiments wherein a shell of a protective helmet receives a force transmitted from an external object that physically engages the shell, the impact cap 200 may be configured to intercept and dissipate at least a portion of the magnitude of the force prior to the force being transmitted to the head of a user. Further, in various embodiments, the impact cap may be configured to transmit at least a portion of the received force to one or more components of the protective helmet, such as, for example, an inner ring, as described herein.

In various embodiments, the impact cap 200 may comprise a substantially lightweight and/or compressible material that is capable of withstanding high-impact forces without being penetrated or otherwise compromised, in particular in conditions of extreme temperatures (e.g., between −32° C. (−25° F.) and 260° C. (500° F.)). For example, in various embodiments, the impact cap 200 may be made of various plastic, composite, and/or foam materials, such as Polyurethane foam. The impact cap 200 may be manufactured using various compression molding, injection molding, CNC machining, additive manufacturing (e.g., 3D printing) processes, and/or the like.

As described herein, the impact cap 200 may comprise an outer impact cap surface 210 and an inner impact cap surface 220. In various embodiments, an outer impact cap surface 210 may be configured to at least partially engage an inner shell surface of a shell such that a force may be received from the shell by the impact cap 200, as described herein. For example, the configuration of the outer impact cap surface 210 may correspond at least in part to a profile of the inner shell surface of the shell. The impact cap 200 may further comprise an internal impact cap portion 230 embodied as an interior of the impact cap 200 that is defined at least in part by an inner impact cap surface 220 of the impact cap 200. The internal impact cap portion 230 may be configured to receive at least a portion of the head of a user such that a protective helmet may be worn by the user on the user's head, as described herein. For example, in various embodiments, at least a portion of the inner impact cap surface 220 may be configured to at least partially engage a user's head and/or an outer liner surface of an inner ring, as described herein. For example, in various embodiments, the inner impact cap surface 220 may be configured at least substantially similarly to the outer impact cap surface 210. In various embodiments, the impact cap 200 may be configured such that the inner impact cap surface 220 is positioned a distance away from the outer impact cap surface 210. The distance between the inner impact cap surface 220 and the outer impact cap surface 210 may define the thickness of the impact cap 200 (e.g., the impact cap thickness). In various embodiments, the impact cap thickness may be either uniform or variable at one or more points throughout the impact cap 200. For example, the impact cap thickness may be at least substantially between 0.197 inches and 0.787 inches (e.g., between 0.394 inches and 0.591 inches).

In various embodiments, impact cap 200 may be embodied as either a full impact cap or a partial impact cap. For example, in various embodiments wherein an impact cap 200 is embodied as a full impact cap, the impact cap 200 may comprise a substantially rounded dome configuration defined in part by an outer impact cap surface 210. The outer impact cap surface 210 may comprise a curved profile extending between an at least substantially circular (e.g., oval-shaped) outer lower perimeter 212 and a central outer cap peak located at an uppermost point of the dome-shaped outer impact cap surface 210 of the impact cap 200. In such an exemplary circumstance, the inner impact cap surface 220 may comprise a substantially similar curved profile extending between an at least substantially circular (e.g., oval-shaped) inner lower perimeter 222 and a central inner peak located at the uppermost point of the dome-shaped inner impact cap surface 220.

Alternatively, as illustrated in FIGS. 4A-4C, an impact cap 200 may be embodied a partial impact cap. In various embodiments, a partial impact cap may comprise an outer impact cap surface 210 having a curved profile extending between the outer lower perimeter 212 and an at least substantially circular (e.g., oval-shaped) outer upper perimeter 213. For example, in various embodiments, the outer upper perimeter 213 may be positioned vertically above the outer lower perimeter 212 and may have a smaller circumference than the outer lower perimeter 212 based at least in part on the radius of curvature of the rounded outer impact cap surface 210. Similarly, a partial impact cap 200 may comprise an inner impact cap surface 220 having a curved profile extending between the inner lower perimeter 222 and an at least substantially circular (e.g., oval-shaped) inner upper perimeter 223. The inner upper perimeter 223 may be positioned vertically above the inner lower perimeter 222 and may have a smaller circumference than the inner lower perimeter 222 based at least in part on the radius of curvature of the rounded inner impact cap surface 220. For example, a partial impact cap may comprise a configuration that is at least substantially similar to that of a lower portion of a full impact cap, as described herein, wherein the lower portion is defined as a portion of the dome-shaped full impact cap below a horizontal cross-sectional plane that extends through the impact cap. In various embodiments, a partial impact cap may comprise an upper impact cap surface 231 extending between the outer upper perimeter 213 and the inner upper perimeter 223. For example, the upper impact cap surface 231 may define at least a portion of the impact cap thickness.

In various embodiments, the impact cap 200 may comprise one or more grooves (e.g., impact cap grooves) extending along at least a portion of the outer impact cap surface 210 and/or the inner impact cap surface 220. As described herein, a groove may embody a material recess within the impact cap thickness of the impact cap 200, such that an exemplary impact cap 200 having one or more grooves may comprise a lesser amount of material than a similarly sized impact cap having the same impact cap thickness and zero grooves. Accordingly, as described herein, the exemplary impact cap 200 having one or more grooves may weigh less than a similarly sized impact cap having the same impact cap thickness and zero grooves. Moreover, in various embodiments, a groove positioned within an impact cap 200 may increase the surface area of the impact cap 200, thereby increasing the heat dissipation capacity of the impact cap 200 by facilitating a more effective heat transfer between an impact cap surface (e.g., the outer impact cap surface 210 and/or the inner impact cap surface 220) and an ambient environment. Furthermore, in various embodiments, the one or more grooves may be configured such that an exemplary impact cap 200 with one or more grooves may exhibit similar strength characteristics and piercing resistance as a similarly configured, heavier impact cap that has no grooves.

In various embodiments, for example, as illustrated in FIG. 4A, an exemplary impact cap 200 may comprise one or more grooves extending along at least a portion of each of the outer impact cap surface 210 (e.g., outer impact cap grooves 211) and the inner impact cap surface 220 (e.g., inner impact cap grooves 221). As a further example, FIG. 4B illustrates an exemplary impact cap 200 comprising one or more outer impact cap grooves 211 extending along at least a portion of the outer impact cap surface 210, wherein the inner impact cap surface 220 does not include any grooves, as described herein. In various embodiments, the outer impact cap grooves 211 may extend from the outer impact cap surface 210 and protrude (e.g., recess) into the impact cap thickness of the impact cap 200. In various embodiments, the outer impact cap grooves 211 may extend along at least a portion of the outer impact cap surface 210 between the outer lower perimeter 212 and the outer upper perimeter 213. In various embodiments, the impact cap 200 may comprise between 72 and 100 outer impact cap grooves (e.g., between 80 and 90 outer impact cap grooves).

Further, FIG. 4C illustrates an exemplary impact cap 200 comprising one or more inner impact cap grooves 221 extending along at least a portion of the inner impact cap surface 220, wherein the outer impact cap surface 210 does not include any grooves, as described herein. In various embodiments, the inner impact cap grooves 221 may extend from the inner impact cap surface 220 and protrude (e.g., recess) into the impact cap thickness of the impact cap 200. In various embodiments, the inner impact cap grooves 221 may extend along at least a portion of the inner impact cap surface 220 between the inner lower perimeter 222 and the inner upper perimeter 223. In various embodiments, the impact cap 200 may comprise between 72 and 100 inner impact cap grooves (e.g., between 80 and 90 inner impact cap grooves).

As described herein in further detail, a groove (e.g., impact cap groove) may be defined at least in part by a groove depth, a groove width, a groove length, and a groove shape. In various embodiments wherein the impact cap 200 comprises a plurality of impact cap grooves, one or more of the impact cap grooves may comprise either the same or different groove depth, groove width, groove length, and/or groove shape. For example, as illustrated in FIG. 4C, an impact cap 200 may comprise a first section including a first portion of impact cap grooves 221A and a second section including a second portion of impact grooves 221B, wherein the groove depth, the groove width, the groove length, and/or the groove shape of the first portion of impact cap grooves 221A is different than the groove depth, the groove width, the groove length, and/or the groove shape, respectively, of the second portion of impact grooves 221B.

Figure 5A:
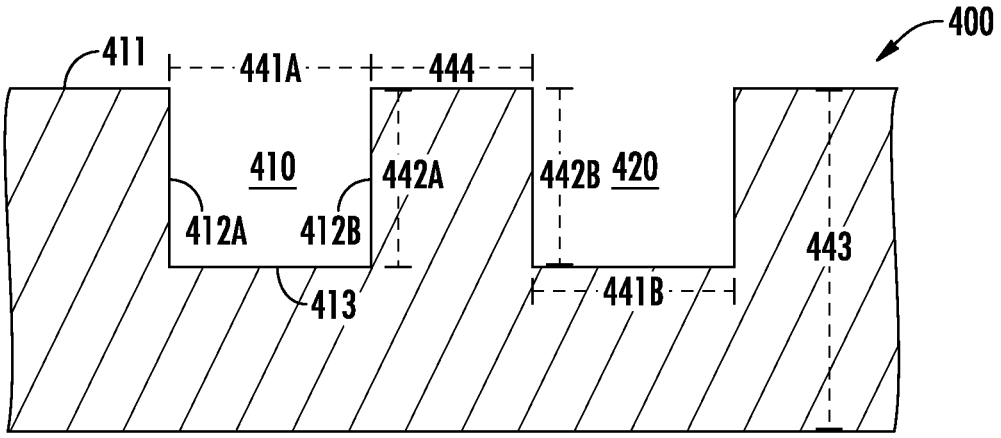
FIGS. 5A-5C illustrate various exemplary cross-sectional views of protective helmets according to various embodiments.
Figure 5B:
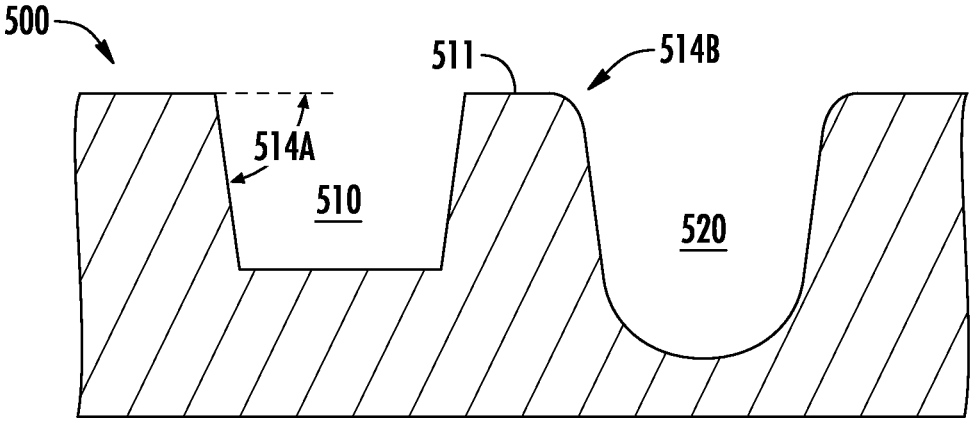
Figure 5C:
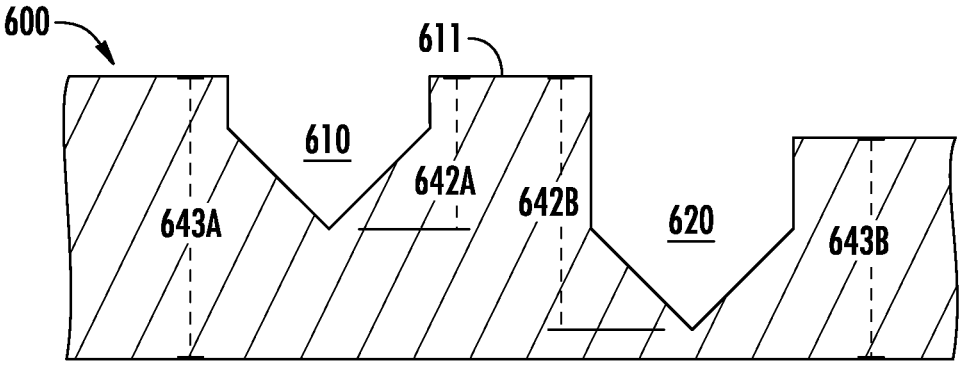

FIGS. 5A-5C illustrate various exemplary cross-sectional views of protective helmets according to various embodiments. In particular, FIGS. 5A-5C illustrate various cross-sectional views of exemplary groove configurations of grooves included in one or more components of a protective helmet described herein. For example, in various embodiments, an impact cap, as described herein, may comprise one or more impact cap grooves configured at least in part according to at least a portion of the exemplary groove configurations 400, 500, 600 illustrated in FIGS. 5A-5C.

FIG. 5A illustrates a cross-sectional view of a non-limiting exemplary groove configuration including a plurality of grooves 410, 420. For example, grooves 410, 420 may be impact cap grooves (e.g., outer impact cap grooves, inner impact cap grooves). As illustrated, an impact cap may comprise, for example, an external surface 411 (e.g., the outer impact cap surface, the inner impact cap surface) and the grooves 410, 420 may extend from the external surface 411 and protrude into the wall thickness 443 of the impact cap (e.g., the impact cap thickness), such that the grooves 410, 420 define a recess of material within the impact cap. A groove 410 may comprise two groove sidewalls 412A, 412B extending from the external surface 411 to an innermost point of recession of the groove 413 (e.g., measured perpendicularly).

In various embodiments, a groove width 441A of a groove 410 may be defined as the distance between the two groove sidewalls 412A, 412B as measured at the external surface 411 perpendicularly to a length of the groove 410. For example, in various embodiments, the groove width of one or more impact cap grooves may be at least substantially between 0.039 inches and 0.197 inches (e.g., between 0.098 inches and 0.138 inches). In various embodiments, the groove configuration 400 may comprise a plurality of impact cap grooves having either the same or different groove widths. For example, in an exemplary embodiment wherein the groove configuration 400 comprises a plurality of impact cap grooves, the groove widths 441A, 441B of grooves 410, 420, respectively, may be either the same or different. Further, in various embodiments, the groove width of an impact cap groove may be either uniform or variable along the length of the groove. In various embodiments, the groove width of the various grooves of an exemplary plurality of impact cap grooves may be configured such that the penetration resistance characteristics of the impact cap are not substantially compromised.

In various embodiments, a groove depth 442A of a groove 410 may be defined as the distance between the external surface 411 into which the groove 410 extends and an innermost point of recession of the groove 413. For example, in various embodiments, the groove depth of one or more impact cap grooves may be at least substantially between 0.02 inches and 0.118 inches (e.g., between 0.059 inches and 0.079 inches). In various embodiments, the groove configuration 400 may comprise a plurality of impact cap grooves having either the same or different groove depths. For example, in an exemplary embodiment wherein the groove configuration 400 comprises a plurality of impact cap grooves, the groove depths 442A, 442B of grooves 410, 420, respectively, may be either the same or different. Further, in various embodiments, the groove depth of an impact cap groove may be either uniform or variable along the length of the groove. In various embodiments, an exemplary impact cap may be configured such that a ratio of the impact cap thickness to a groove depth of a proximate groove is at least substantially between 1.167:1 and 3.5:1 (e.g., between 1.5:1 and 3:1). For example, an exemplary impact cap may comprise a groove configuration 400 configured such that the ratio of the wall thickness 443 (e.g., impact cap thickness) to groove depth 442B of groove 420 is approximately 2.25:1).

In various embodiments, a groove shape of a groove 410 may be defined as the cross-sectional configuration of the groove 410. As non-limiting examples, in various embodiments, an impact cap groove may comprise a squared cross-section, a rounded cross-section, a triangular cross-section, and/or the like. In various embodiments, the groove configuration 400 may comprise a plurality of impact cap grooves having either the same or different groove shapes. For example, in an exemplary embodiment wherein the groove configuration 400 comprises a plurality of impact cap grooves, the groove shapes of grooves 410, 420 may be either the same or different. As illustrated in FIG. 4A, grooves 410, 420 each comprise a square groove shape. Further, in various embodiments, the groove shape of an impact cap groove may be either uniform or variable along the length of the groove.

In various embodiments, an impact cap may comprise a groove configuration that is defined at least in part by one or more groove separation distances. As described herein, a groove separation distance may be defined by a distance between various proximate grooves of a plurality of grooves as measured at an external surface into which the grooves protrude. For example, in various embodiments wherein an impact cap comprises a plurality of impact cap grooves, the plurality of impact cap grooves may be distributed about the impact cap such that a first groove is positioned proximate to a second groove, wherein the first groove and the second groove are separated by a groove separation distance. For example, the groove separation distance may be measured between adjacent sidewalls of the two proximate grooves. As illustrated in FIG. 5A, groove configuration 400 may be defined at least in part by groove separation distance 444. For example, groove 410 and groove 420 positioned proximate thereto may be separated by groove separation distance 444. In various embodiments, the groove separation distance between two impact proximate grooves may be at least substantially between 0.039 inches and 0.197 inches (e.g., between 0.098 inches and 0.138 inches). Further, in various embodiments, the groove separation distance between various pairs of proximate impact cap grooves may be either uniform or variable throughout a plurality of impact cap grooves. Additionally and/or alternatively, in various embodiments, the groove separation distance between various pairs of proximate impact cap grooves may be either uniform or variable along the respective lengths of the grooves.

As illustrated in FIG. 5B, a groove configuration 500 may comprise a plurality of grooves including a first groove 510 and a second groove 520. As described herein, an impact cap having a plurality of grooves (e.g., impact cap grooves) in a groove configuration 500 may comprise a first groove 510 having a first groove shape and a second groove 520 having a second groove shape. For example, as shown, groove 510 may comprise a squared groove shape and groove 520 may comprise a rounded groove shape.

Further, as described herein, a groove (e.g., an impact cap groove) may comprise a groove transition, defined at least in part by the configuration of the transition between external surface into which the groove extends and a sidewall of the groove. As non-limiting examples, an impact cap groove may comprise a groove transition that is either an angled groove transition or a curved groove transition. As illustrated in FIG. 5B, groove 510 comprises an angled groove transition defined in part by groove transition angle 514A. For example, an impact cap groove may comprise a groove transition angle 514A of at least substantially between 0 degrees and 90 degrees (e.g., between 45 degrees and 90 degrees) relative to the external surface 511. Further, as illustrated, groove 520 comprises a rounded groove transition defined in part by groove transition radius of curvature 514B. For example, an impact cap groove may comprise a groove transition radius of curvature 514B of between 0.039 inches and 0.197 inches (e.g., between 0.098 inches and 0.138 inches).

Further, As illustrated in FIG. 5C, a groove configuration 600 may comprise a plurality of grooves including a first groove 610 and a second groove 620, wherein each of the plurality of grooves comprise a pointed groove shape (e.g., an at least partially triangular cross-sectional configuration). As described herein, an impact cap having a plurality of grooves (e.g., impact cap grooves) in may comprise a first groove 610 having a first groove depth 642A and a second groove 620 having a second groove depth 642B, wherein the respective groove depths 642A, 642B comprise different values. Further, as described herein, in various embodiments, the impact cap thickness may be either uniform or variable at one or more points throughout the impact cap. For example, a wall thickness 643A (e.g., a first impact cap thickness) measured at a first location on, for example, an impact cap, may be at least substantially different than wall thickness 643B (e.g., a second impact cap thickness) measured at a second location.

In various embodiments, the plurality of impact cap grooves may correspond to a material reduction of at least substantially between 60 grams and 100 grams (e.g., between 75 grams and 85 grams) of material, which, based at least in part on the material of an impact cap, may result in a weight reduction of at least substantially between 15% and 25% (e.g., approximately 20%) to the impact cap.

Figure 6A:
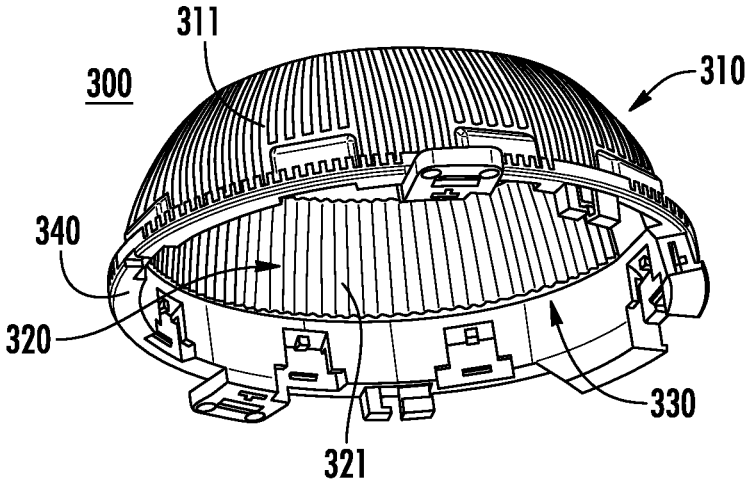
FIGS. 6A-6C illustrate various perspective views of various components of a protective helmet according to various embodiments.
Figure 6B:
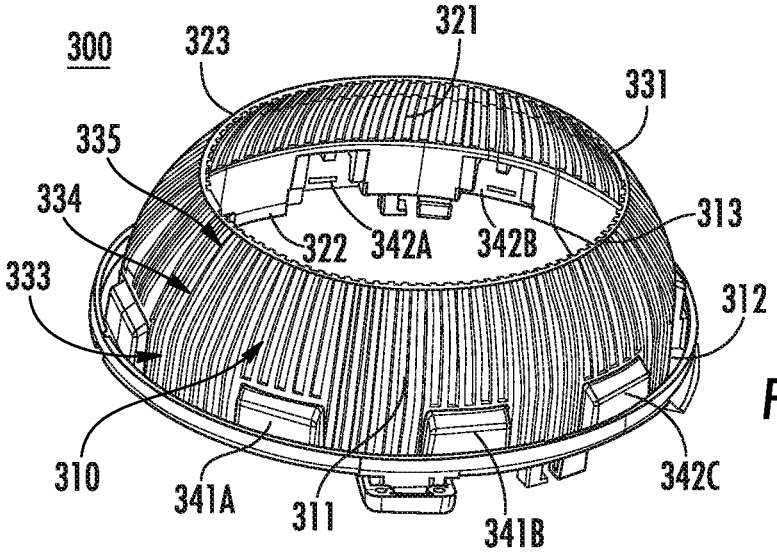
Figure 6C:
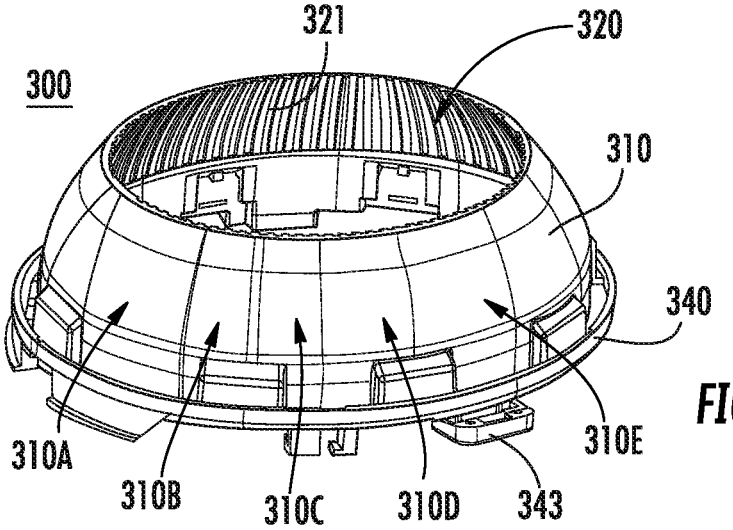

FIGS. 6A-6C illustrate an exemplary component of a protective helmet according to various embodiments. In particular, FIGS. 6A-6C show various perspective views of an exemplary inner ring 300 according to various embodiments. As described herein, a protective helmet may be configured such that an inner ring 300 may be arranged within an internal shell portion of a shell and/or an internal impact cap portion of an impact cap, as described herein. For example, in various embodiments, the inner ring 300 of a protective helmet may be configured to fit at least partially within the internal impact cap portion of an impact cap such that the inner ring 300 may act as an intermediate buffer positioned in between the impact cap and/or a shell of the protective helmet and the head of a user. In various embodiments, an inner ring 300 may comprise an internal inner ring portion 330 configured to receive at least a portion of a user's head such that the inner ring 300 may define an interface at which the user's head may engage a protective helmet such that the protective helmet rests on top of the user's head. In various embodiments wherein a shell and/or impact cap of a protective helmet receives a force transmitted from an external object that physically engages the shell, the inner ring 300 may be configured to intercept and dissipate at least a portion of the magnitude of the force prior to the force being transmitted to the head of a user.

In various embodiments, the inner ring 300 may comprise a substantially hard material that is capable of withstanding high-impact forces without being penetrated or otherwise compromised, in particular in conditions of extreme temperatures (e.g., between −32° C. (−25° F.) and 260° C. (500° F.)). For example, in various embodiments, the inner ring 300 may be made of various plastic and/or metal materials, such as thermoplastics. The inner ring 300 may be manufactured using various compression molding, injection molding, CNC machining, additive manufacturing (e.g., 3D printing) processes, and/or the like.

As described herein, the inner ring 300 may comprise an outer inner ring surface 310 and an internal inner ring surface 320. In various embodiments, an outer inner ring surface 310 may be configured to at least partially engage an inner impact cap surface of an impact cap such that a force may be received from the impact cap by the inner ring 300, as described herein. For example, the configuration of the outer inner ring surface 310 may correspond at least in part to a profile of the internal inner ring surface of the impact cap. The inner ring 300 may further comprise an internal inner ring portion 330 embodied as an interior of the inner ring 300 that is defined at least in part by an internal inner ring surface 320. The internal inner ring portion 330 may be configured to receive at least a portion of the head of a user such that a protective helmet may be worn by the user on the user's head, as described herein. For example, in various embodiments, at least a portion of the internal inner ring surface 320 may be configured to at least partially engage a user's head. For example, in various embodiments, the internal inner ring surface 320 may be configured at least substantially similarly to the outer inner ring surface 310. In various embodiments, the inner ring 300 may be configured such that the internal inner ring surface 320 is positioned a distance away from the outer inner ring surface 310. The distance between the internal inner ring surface 320 and the outer inner ring surface 310 may define the thickness of the impact cap liner 300 (e.g., the inner ring thickness). In various embodiments, the inner ring thickness may be either uniform or variable at one or more points throughout the inner ring 300. For example, the inner ring thickness may be at least substantially between 0.06 inch and 0.16 inches (e.g., between 0.08 inches and 0.12 inches).

In various embodiments, an inner ring 300 may comprise one or more support protrusions In various embodiments, an inner ring 300 may be embodied as either a full inner ring or a partial inner ring. For example, in various embodiments wherein an inner ring 300 is embodied as a full inner ring, the inner ring 300 may comprise a substantially rounded dome configuration defined in part by an outer inner ring surface 310. The outer inner ring surface 310 may comprise an at least partially curved profile extending between an at least substantially circular (e.g., oval-shaped) outer lower perimeter 312 and a central outer cap peak located at an uppermost point of the dome-shaped outer inner ring surface 310 of the inner ring 300. In such an exemplary circumstance, the internal inner ring surface 320 may comprise an at least partially similar curved profile extending between an at least substantially circular (e.g., oval-shaped) inner lower perimeter 322 and a central inner peak located at the uppermost point of the dome-shaped internal inner ring surface 320.

Alternatively, as illustrated in FIGS. 6A-6C, an inner ring 300 may be embodied a partial inner ring. In various embodiments, a partial impact cap may comprise an outer inner ring surface 310 having a curved profile extending between the outer lower perimeter 312 and an at least substantially circular (e.g., oval-shaped) outer upper perimeter 313. For example, in various embodiments, the outer upper perimeter 313 may be positioned vertically above the outer lower perimeter 312 and may have a smaller circumference than the outer lower perimeter 312 based at least in part on the radius of curvature of the rounded outer inner ring surface 310. Similarly, a partial inner ring 300 may comprise an internal inner ring surface 320 having a curved profile extending between the inner lower perimeter 322 and an at least substantially circular (e.g., oval-shaped) inner upper perimeter 323. The inner upper perimeter 323 may be positioned vertically above the inner lower perimeter 322 and may have a smaller circumference than the inner lower perimeter 322 based at least in part on the radius of curvature of the rounded internal inner ring surface 320. For example, a partial inner ring may comprise a configuration that is at least substantially similar to that of a lower portion of a full inner ring, as described herein, wherein the lower portion is defined as a portion of the dome-shaped full inner ring that is below a horizontal cross-sectional plane that extends through the inner ring. In various embodiments, a partial inner ring may comprise an upper impact cap surface 331 extending between the outer upper perimeter 313 and the inner upper perimeter 323. For example, the upper inner ring surface 331 may define at least a portion of the inner ring thickness. In various embodiments, an exemplary inner ring, as described herein, may be embodied as a suspension ring assembly.

As illustrated in FIG. 6B, in various embodiments, an inner ring 300 may comprise a lower portion 333, an intermediate portion 334, and an upper portion 335. In various embodiments, a lower portion 333 of an inner ring 300 may comprise a substantially vertical portion configuration extending upwards from the lower perimeter(s) (e.g., the outer lower perimeter 312 and the inner lower perimeter 322).

In various embodiments, the lower portion 333 may comprise an inner ring brim portion 340 extending in an outward perpendicular direction from the outer inner ring surface 310 along at least a portion of the outer lower perimeter 312 of the inner ring 300. For example, as illustrated, the inner ring brim portion 340 may extend around the entirety of the lower perimeter of the inner ring 300. In various embodiments, the inner ring brim portion 340 may further comprise a vertical ridge that extends in a substantially vertical direction upward from an outer edge of the inner ring brim portion 340. In various embodiments, the vertical ridge of the inner ring brim portion 340 may comprise a substantially uniform protrusion of material extending around the entirety of the inner ring brim portion 340. Alternatively and/or additionally, the vertical ridge of the inner ring brim portion 340 may comprise one or more grooves, distributed around the ridge, as described herein, so as to reduce the amount of material required to make inner ring 300. In various embodiments, the inner ring brim portion 340 may be configured to facilitate an integrated and secured configuration between the inner ring 300 and one or more other components of a protective helmet, as described herein. Further, in various embodiments, the inner ring brim portion 340 may comprise one or more inner ring interface elements 343 configured to engage one or more other components of an exemplary protective helmet so as to at least partially secure (e.g., fasten) the inner ring to the one or more other helmet components. As a non-limiting example, an exemplary inner ring may comprise four interface elements 343 arranged at substantially 90 degree intervals around the perimeter of the inner ring brim portion 340.

In various embodiments, the lower portion 333 of an inner ring 300 may further comprise one or more outer protrusions 341A, 341B, 341C extending in an outward direction from the outer inner ring surface 310 along at least a portion of the lower 333 of the inner ring 300. The outer protrusions 341A, 341B, 341C may comprise a generally convex feature extending radially away from the outer inner ring surface 310. For example, an inner ring 300 may comprise a plurality of outer protrusions distributed intermittently about the lower portion 333 of the inner ring 300. In various embodiments, the outer protrusions 341A, 341B, 341C of the inner ring may be configured so as to increase one or more strength characteristics (e.g., crushing resistance, penetration resistance, and/or the like) of an inner ring 300. Alternatively and/or additionally, each of the one or more outer protrusions (e.g., outer protrusions 341A, 341B, 341C) may respectively correspond to one or more inner recesses of the inner ring 300 (e.g., inner recess 342A, 342B). In various embodiments, the inner ring 300 may comprise one or more inner recesses 342A, 342B extending the internal inner ring surface 320 into the impact cap thickness along at least a portion of the lower 333 of the inner ring 300. For example, the inner recess 342A, 342B may be configured to receive interface elements of one or more other components of an exemplary protective helmet, as described herein. In such a circumstance, the one or more outer protrusions 341A, 341B, of the inner ring 300 may be configured to protrude from the outer inner ring surface 310 so as to prevent the respective interface elements received within the corresponding inner recesses 342A, 342B from being exposed through the outer inner ring surface 310. Further, in various embodiments, the outer protrusions 341A, 341B, 341C may be configured to define a spatial configuration of the inner ring 300 relative to one or more other components of a protective helmet, as described herein. As a non-limiting example, the outer protrusions 341A, 341B, 341C may be configured to maintain a gap between at least a portion of the outer inner ring surface 310 and at least a portion of the inner shell surface, wherein the gap is at least substantially between 0.394 inches and 0.984 inches (e.g., between 0.591 inches and 0.787 inches). In various embodiments, an exemplary inner ring 300 having a plurality of outer protrusions, as described herein, may comprise between six and twelve outer protrusions (e.g., between eight and ten outer protrusions).

In various embodiments, an intermediate portion 334 of an inner ring 300 may comprise a substantially curved profile extending upwards from the lower portion 333 of the inner ring 300 to an upper portion 335. Similarly, an upper portion 335 of an inner ring 300 may comprise a substantially curved profile extending upwards from the intermediate portion 334 of the inner ring 300 to either a central peak at the uppermost point of a dome-shaped full inner ring or an upper impact cap surface 331 defining the uppermost surface of a partial inner ring 300. As described herein, the intermediate portion 334 and the upper portion 335 of an exemplary inner ring 300 may each comprise a radius of curvature and an inner ring thickness profile defined by the distribution of impact cap thickness throughout the respective portion. In various embodiments, the radius of curvature and the inner ring thickness profile of the intermediate portion 334 may be either the same or different than radius of curvature and/or the inner ring thickness profile, respectively, of the upper portion 335 of the inner ring 300. For example, in various embodiments, the impact cap thickness of at least a portion of the upper portion 335 may be smaller than that of the intermediate portion 334. As a further non-limiting example, in various embodiments, the radius of curvature of the upper portion 335 may be larger than that of the intermediate portion 334. In various embodiments, the boundary between the intermediate portion 334 and the upper portion 335 may be defined in part by a distinct change in radius of curvature and/or inner ring thickness. For example, the inner ring thickness of the intermediate portion 334 may be approximately 0.11 inches, while the inner ring thickness of the upper portion 335 may be approximately 0.09 inches.

In various embodiments, the inner ring 300 may comprise one or more grooves (e.g., inner ring grooves) extending along at least a portion of the outer inner ring surface 310 and/or the internal inner ring surface 320. As described herein, a groove may embody a material recess within the inner ring thickness of the inner ring 300, such that an exemplary inner ring 300 having one or more grooves may comprise a lesser amount of material than a similarly sized inner ring having the same inner ring thickness and zero grooves. Accordingly, as described herein, the exemplary inner ring 300 having one or more grooves may weigh less than a similarly sized inner ring having the same inner ring thickness and zero grooves. Moreover, in various embodiments, a groove positioned within an inner ring 300 may increase the surface area of the inner ring 300, thereby increasing the heat dissipation capacity of the inner ring 300 by facilitating a more effective heat transfer between an inner ring surface (e.g., the outer inner ring surface 310 and/or the internal inner ring surface 320) and an ambient environment. Furthermore, in various embodiments, the one or more inner ring grooves may be configured such that an exemplary inner ring 300 with one or more grooves may exhibit similar strength characteristics and piercing resistance as a similarly configured, heavier impact cap that has no grooves.

In various embodiments, for example, as illustrated in FIG. 6A, an exemplary inner ring 300 may comprise one or more grooves extending along at least a portion of each of the outer inner ring surface 310 (e.g., outer inner ring grooves 311) and the internal inner ring surface 320 (e.g., internal inner ring grooves 321). As a further example, FIG. 6B illustrates an exemplary inner ring 300 comprising one or more outer inner ring grooves 311 extending along at least a portion of the outer inner ring surface 310, wherein the internal inner ring surface 320 does not include any grooves, as described herein. In various embodiments, the outer inner ring grooves 311 may extend from the outer inner ring surface 310 and protrude (e.g., recess) into the inner ring thickness of the inner ring 300. In various embodiments, the outer inner ring grooves 311 may extend along at least a portion of the outer inner ring surface 310 between the outer lower perimeter 312 and the outer upper perimeter 313.

Further, FIG. 6C illustrates an exemplary inner ring 300 comprising one or more internal inner ring grooves 321 extending along at least a portion of the internal inner ring surface 320, wherein the outer inner ring surface 310 does not include any grooves, as described herein. In various embodiments, the internal inner ring grooves 321 may extend from the internal inner ring surface 320 and protrude (e.g., recess) into the inner ring thickness of the inner ring 300. In various embodiments, the internal inner ring grooves 321 may extend along at least a portion of the internal inner ring surface 320.

As described herein in further detail, a groove (e.g., inner ring groove) may be defined at least in part by a groove depth, a groove width, a groove length, and a groove shape. In various embodiments wherein the inner ring 300 comprises a plurality of inner ring grooves, one or more of the inner ring grooves may comprise either the same or different groove depth, groove width, groove length, and/or groove shape. For example, as illustrated in FIG. 6C, an inner ring 300 may comprise a plurality of different inner ring sections (e.g., inner ring sections 310A, 310B, 310C, 310D, 310E). In various embodiments, one or more of the plurality of inner ring sections (e.g., inner ring sections 310A, 310B, 310C, 310D, 310E) may comprise one or more inner ring grooves having a groove depth, groove width, groove length, and/or groove shape that is different than the groove depth, the groove width, the groove length, and/or the groove shape, respectively, of another inner ring section of the plurality of inner ring sections. Similarly, in various embodiments, one or more of the plurality of inner ring sections (e.g., inner ring sections 310A, 310B, 310C, 310D, 310E) may comprise an inner ring thickness that is at least partially different than the inner ring thickness of another inner ring section of the plurality of inner ring sections. For example, in such an exemplary circumstance, the boundary between the proximate inner ring sections of the plurality of inner ring sections (e.g., of inner ring sections 310A, 310B, 310C, 310D, 310E) may be defined in part by a distinct change in inner ring thickness.

As described above with respect to various exemplary inner ring groove configurations, FIGS. 5A-5C illustrate various cross-sectional views of exemplary groove configurations of grooves included in one or more components of a protective helmet described herein. For example, in various embodiments, an inner ring, as described herein, may comprise one or more inner ring grooves configured at least in part according to at least a portion of the exemplary groove configurations 400, 500, 600 illustrated in FIGS. 5A-5C.

For example, as illustrated in FIG. 5A, grooves 410, 420 may be inner ring grooves (e.g., outer inner ring grooves, internal inner ring grooves). As illustrated, an inner ring may comprise, for example, an external surface 411 (e.g., the outer inner ring surface, the internal inner ring surface) and the grooves 410, 420 may extend from the external surface 411 and protrude into the wall thickness 443 of the inner ring (e.g., the inner ring thickness), such that the grooves 410, 420 define a recess of material within the inner ring.

As described herein, a groove width 441A of a groove 410 may be defined as the distance between the two groove sidewalls 412A, 412B as measured at the external surface 411 perpendicularly to a length of the groove 410. For example, in various embodiments, the groove width of one or more inner ring grooves may be at least substantially between 0.039 inches and 0.197 inches (e.g., between 0.098 inches and 0.138 inches). In various embodiments, the groove configuration 400 may comprise a plurality of inner ring grooves having either the same or different groove widths. For example, in an exemplary embodiment wherein the groove configuration 400 comprises a plurality of inner ring grooves, the groove widths 441A, 441B of grooves 410, 420, respectively, may be either the same or different. Further, in various embodiments, the groove width of an inner ring groove may be either uniform or variable along the length of the groove. In various embodiments, the groove width of the various grooves of an exemplary plurality of inner ring grooves may be configured such that the penetration resistance characteristics of the inner ring are not substantially compromised.

Further, as described herein, a groove depth 442A of a groove 410 may be defined as the distance between the external surface 411 into which the groove 410 extends and an innermost point of recession of the groove 413. For example, in various embodiments, the groove depth of one or more inner ring grooves may be at least substantially between 0.02 inches and 0.118 inches (e.g., between 0.059 inches and 0.079 inches). In various embodiments, the groove configuration 400 may comprise a plurality of inner ring grooves having either the same or different groove depths. For example, in an exemplary embodiment wherein the groove configuration 400 comprises a plurality of inner ring grooves, the groove depths 442A, 442B of grooves 410, 420, respectively, may be either the same or different. Further, in various embodiments, the groove depth of an inner ring groove may be either uniform or variable along the length of the groove. In various embodiments, an exemplary inner ring may be configured such that a ratio of the inner ring thickness to a groove depth of a proximate groove is at least substantially between 1.167:1 and 3.5:1 (e.g., between 1.5:1 and 3:1). For example, an exemplary inner ring may comprise a groove configuration 400 configured such that the ratio of the wall thickness 443 (e.g., inner ring thickness) to groove depth 442B of groove 420 is approximately 2.25:1).

As described herein, a groove shape of a groove 410 may be defined as the cross-sectional configuration of the groove 410 (e.g., at the deepest portion of the groove). As non-limiting examples, in various embodiments, an inner ring groove may comprise a squared cross-section, a rounded cross-section, a triangular cross-section, and/or the like. In various embodiments, the groove configuration 400 may comprise a plurality of inner ring grooves having either the same or different groove shapes. For example, in an exemplary embodiment wherein the groove configuration 400 comprises a plurality of inner ring grooves, the groove shapes of grooves 410, 420 may be either the same or different. As illustrated in FIG. 4A, grooves 410, 420 each comprise a square groove shape. Further, in various embodiments, the groove shape of an inner ring groove may be either uniform or variable along the length of the groove.

In various embodiments, an inner ring may comprise a groove configuration that is defined at least in part by one or more groove separation distances, as described herein. For example, in various embodiments wherein an inner ring comprises a plurality of inner ring grooves, the plurality of inner ring grooves may be distributed about the inner ring such that a first groove is positioned proximate to a second groove, wherein the first groove and the second groove are separated by a groove separation distance. For example, the groove separation distance may be measured between adjacent sidewalls of the two proximate grooves. As illustrated in FIG. 5A, groove configuration 400 may be defined at least in part by groove separation distance 444. For example, groove 410 and groove 420 positioned proximate thereto may be separated by groove separation distance 444. In various embodiments, the groove separation distance between two impact proximate inner ring grooves may be at least substantially between 0.039 inches and 0.197 inches (e.g., between 0.098 inches and 0.138 inches). Further, in various embodiments, the groove separation distance between various pairs of proximate inner ring grooves may be either uniform or variable throughout a plurality of inner ring grooves. Additionally and/or alternatively, in various embodiments, the groove separation distance between various pairs of proximate inner ring grooves may be either uniform or variable along the respective lengths of the grooves.

As illustrated in FIG. 5B, an inner ring having a plurality of grooves (e.g., inner ring grooves) in a groove configuration 500 may comprise a first groove 510 having a first groove shape and a second groove 520 having a second groove shape. For example, as shown, groove 510 may comprise a squared groove shape and groove 520 may comprise a rounded groove shape.

Further, as described herein, a groove (e.g., an inner ring groove) may comprise a groove transition, defined at least in part by the configuration of the transition between external surface into which the groove extends and a sidewall of the groove. As non-limiting examples, an inner ring groove may comprise a groove transition that is either an angled groove transition or a curved groove transition. As illustrated in FIG. 5B, groove 510 comprises an angled groove transition defined in part by groove transition angle 514A. For example, an inner ring groove may comprise a groove transition angle 514A of at least substantially between 0 degrees and 90 degrees (e.g., between 45 degrees and 90 degrees) relative to the external surface 511. Further, as illustrated, groove 520 comprises a rounded groove transition defined in part by groove transition radius of curvature 514B. For example, an inner ring groove may comprise a groove transition radius of curvature 514B of at least substantially between 0.039 inches and 0.197 inches (e.g., between 0.098 inches and 0.138 inches).

Further, As illustrated in FIG. 5C, a groove configuration 600 may comprise a plurality of grooves including a first groove 610 and a second groove 620, wherein each of the plurality of grooves comprise a pointed groove shape (e.g., an at least partially triangular cross-sectional configuration). As described herein, an inner ring having a plurality of grooves (e.g., inner ring grooves) in may comprise a first groove 610 having a first groove depth 642A and a second groove 620 having a second groove depth 642B, wherein the respective groove depths 642A, 642B comprise different values. Further, as described herein, in various embodiments, the inner ring thickness may be either uniform or variable at one or more points throughout the impact cap. For example, a wall thickness 643A (e.g., a first inner ring thickness) measured at a first location on, for example, an impact cap, may be at least substantially different than wall thickness 643B (e.g., a second inner ring thickness) measured at a second location.

As described herein, in various embodiments, an exemplary inner ring may comprise a lower portion, an intermediate portion, and/or an upper portion. In various embodiments, one or more of the lower portion, the intermediate portion, and/or the upper portion may comprise one or more inner ring grooves having a groove depth, groove width, groove length, and/or groove shape that is different than the groove depth, the groove width, the groove length, and/or the groove shape, respectively, of another one of one of the lower portion, the intermediate portion, and/or the upper portion of the inner ring. For example, as a non-limiting example, an inner ring may comprise an inner ring groove having a groove depth of an approximately 0.075 inches within the lower portion, approximately 0.068 inches within the intermediate portion, and approximately 0.062 inches within the upper portion of an inner ring. Further, as a non-limiting example, an exemplary inner ring may be configured such that a ratio of the inner ring thickness to a groove depth of a proximate inner ring groove is approximately 1.95:1 within the lower portion, approximately 2.35:1 within the intermediate portion, and approximately 2.75:1 within the upper portion of an inner ring.

In various embodiments, the plurality of inner ring grooves may correspond to a material reduction of at least substantially between 50 grams and 400 grams (e.g., between 200 grams and 350 grams) of material, which, based at least in part on the material of an inner ring, may result in a weight reduction of at least substantially between 15% and 25% (e.g., approximately 20%) to the inner ring.

Various computer-aided simulations were conducted wherein various inner rings comprising a baseline inner ring configuration, a first exemplary inner ring configuration, a second exemplary inner ring configuration, a third exemplary inner ring configuration, and a fourth exemplary inner ring configuration were each subjected to a 700N point force applied perpendicularly to the respective upper portions of the various inner rings. As described in further detail below, each of the each of the various exemplary inner ring configurations were defined at least in part by inner ring thickness and a groove configuration, the groove configuration being defined in part by a plurality of outer inner ring grooves having uniform groove depth, groove width, groove shape, and groove separation distance. In the computer-aided simulations, each of the various exemplary inner rings were subjected to fully fixed conditions at each of the four interface elements arranged at substantially 90 degree intervals around the perimeter of the inner ring brim portion, as well as a perpendicularly fixed condition in a radially outward direction at the vertical ridge of the inner ring brim portion, as described herein. Each of the tested inner rings was made of Lexan 241 R, a material having a density of 1.19 g/cc, a Young's modulus of 2340 MPa, a yield stress of 62 MPa, and a tensile stress of 68 MPa. The computer aided simulations were conducted to assess the weight savings, maximum deflection, and maximum stress realized by each of the exemplary inner rings.

A baseline experimental simulation was conducted on a baseline inner ring configuration having a wall thickness of 0.118 inches and no inner ring grooves. When loaded with the experimental 700N point force described above, the baseline inner ring configuration experienced a maximum deflection of 8.34 mm and a maximum stress of 55 MPa.

An experimental simulation was conducted on a first exemplary inner ring configuration having an inner ring thickness of 0.118 inches and a groove configuration defined by a plurality of uniform inner ring grooves, each having a squared groove shape and an angled groove transition of at least substantially 90 degrees, as described herein. Further, the plurality of uniform inner ring grooves of the first exemplary inner ring configuration each have a groove depth of 0.063 inches and a groove width of 0.046 inches, with the plurality of grooves defining a uniform groove separation distance of 0.046 inches between each of the plurality of grooves. When loaded with the experimental 700N point force described above, the first exemplary inner ring configuration experienced a maximum deflection of 14.8 mm (a 77% increase compared to the baseline inner ring configuration) and a maximum stress of 134 MPa (a 143% increase compared to the baseline inner ring configuration). The first exemplary inner ring configuration related to a weight reduction of 47.2 g relative to the baseline inner ring configuration.

An experimental simulation was conducted on a second exemplary inner ring configuration having an inner ring thickness of 0.118 inches and a groove configuration defined by a plurality of uniform inner ring grooves, each having a squared groove shape and an angled groove transition of at least substantially 90 degrees, as described herein. Further, the plurality of uniform inner ring grooves of the second exemplary inner ring configuration each have a groove depth of 0.049 inches and a groove width of 0.046 inches, with the plurality of grooves defining a uniform groove separation distance of 0.046 inches between each of the plurality of grooves. When loaded with the experimental 700N point force described above, the second exemplary inner ring configuration experienced a maximum deflection of 12.27 mm (a 47% increase compared to the baseline inner ring configuration) and a maximum stress of 105 MPa (a 90% increase compared to the baseline inner ring configuration). The second exemplary inner ring configuration related to a weight reduction of 30 g relative to the baseline inner ring configuration.

An experimental simulation was conducted on a third exemplary inner ring configuration having an inner ring thickness of 0.118 inches and a groove configuration defined by a plurality of uniform inner ring grooves, each having a squared groove shape and an angled groove transition of at least substantially 90 degrees, as described herein. Further, the plurality of uniform inner ring grooves of the third exemplary inner ring configuration each have a groove depth of 0.063 inches and a groove width of 0.16 inches, with the plurality of grooves defining a uniform groove separation distance of 0.08 inches between each of the plurality of grooves. When loaded with the experimental 700N point force described above, the third exemplary inner ring configuration experienced a maximum deflection of 13.8 mm (a 65% increase compared to the baseline inner ring configuration) and a maximum stress of 126 MPa (a 129% increase compared to the baseline inner ring configuration). The third exemplary inner ring configuration related to a weight reduction of 45.49 g relative to the baseline inner ring configuration.

An experimental simulation was conducted on a fourth exemplary inner ring configuration having an impact cap thickness of 0.118 inches and a groove configuration defined by a plurality of uniform inner ring grooves, each having a squared groove shape and an angled groove transition of at least substantially 90 degrees, as described herein. Further, the plurality of uniform inner ring grooves of the fourth exemplary inner ring configuration each have a groove depth of 0.049 inches and a groove width of 0.16 inches, with the plurality of grooves defining a uniform groove separation distance of 0.08 inches between each of the plurality of grooves. When loaded with the experimental 700N point force described above, the fourth exemplary inner ring configuration experienced a maximum deflection of 11.5 mm (a 37% increase compared to the baseline inner ring configuration) and a maximum stress of 106 MPa (a 92% increase compared to the baseline inner ring configuration). The fourth exemplary inner ring configuration related to a weight reduction of 36 g relative to the baseline inner ring configuration.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A protective helmet comprising:

a protective shell having a substantially dome-shaped configuration, the protective shell comprising:

an outer shell surface;

an inner shell surface comprising a lower perimeter and defining, at least in part, an internal shell portion configured to receive at least a portion of a head of a user extending through the lower perimeter of the inner shell surface; and at least one groove extending along at least a portion of the inner shell surface, wherein the at least one groove is defined at least in part by a groove depth;

wherein the protective shell is defined at least in part by a shell thickness defined at least in part by a perpendicular distance between the outer shell surface and the inner shell surface;

wherein the at least one groove is embodied as a material recess within the shell thickness extending from the inner shell surface to a recession point, wherein the groove depth of the at least one groove is defined at least in part by a distance between the inner shell surface and the recession point of the at least one groove; and wherein a first groove of the at least one groove has a first groove shape and a second groove of the at least one groove has a second groove shape, wherein the first groove shape comprises a squared groove shape and the second groove shape comprises a rounded groove shape.

2. A protective helmet comprising:

a protective shell; and an inner ring;

wherein each of the protective shell and the inner ring are defined by a respective wall thickness; and wherein at least one of the protective shell and the inner ring comprises at least one groove, wherein the at least one groove is embodied as a material recess extending into the respective wall thickness from a respective surface thereof, wherein a first groove of the at least one groove has a first groove shape and a second groove of the at least one groove has a second groove shape, wherein the first groove shape comprises a squared groove shape and the second groove shape comprises a rounded groove shape.

3. The protective helmet of claim 2, wherein each of the protective shell and the inner ring comprises a respective groove configuration.

4. The protective helmet of claim 2, further comprising an impact cap, wherein the protective helmet is configured such that the impact cap is positioned at least partially between the protective shell and the inner ring such that the impact cap defines an intermediate buffer between the shell and the inner ring.

5. The protective helmet of claim 4, wherein the impact cap comprises at least one impact cap groove configuration defined by one or more impact cap grooves, wherein the one or more impact cap groove are embodied as a material recess extending into an impact cap wall thickness from an external surface thereof.

6. A protective helmet comprising:

a protective shell;

an impact cap; and an inner ring;

wherein each of the protective shell, the impact cap, and the inner ring are defined by a respective wall thickness; and wherein one or more of the protective shell, the impact cap, and the inner ring comprises by one or more grooves, wherein the one or more grooves are embodied as a material recess extending into the respective wall thickness from a respective surface thereof, and a first groove of the one or more grooves has a first groove shape and a second groove of the one or more grooves has a second groove shape, wherein the first groove shape comprises a squared groove shape and the second groove shape comprises a rounded groove shape.

7. The protective helmet of claim 6, wherein each of the protective shell, the impact cap, and the inner ring comprises a respective groove configuration.

* * * * *